US011613117B2

(12) United States Patent
Gardner et al.

(10) Patent No.: US 11,613,117 B2
(45) Date of Patent: Mar. 28, 2023

(54) MULTIPLE CIRCUITS COUPLED TO AN INTERFACE

(71) Applicant: HEWLETT-PACKARD DEVELOPMENT COMPANY, L.P., Spring, TX (US)

(72) Inventors: James Michael Gardner, Corvallis, OR (US); Scott A. Linn, Corvallis, OR (US); Michael W. Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 202 days.

(21) Appl. No.: 16/956,331

(22) PCT Filed: Feb. 6, 2019

(86) PCT No.: PCT/US2019/016725

§ 371 (c)(1),
(2) Date: Jun. 19, 2020

(87) PCT Pub. No.: WO2020/162887

PCT Pub. Date: Aug. 13, 2020

(65) Prior Publication Data

US 2021/0213732 A1 Jul. 15, 2021

(51) Int. Cl.
*B41J 2/045* (2006.01)

(52) U.S. Cl.
CPC ..... *B41J 2/04541* (2013.01); *B41J 2/04555* (2013.01); *B41J 2/04586* (2013.01)

(58) Field of Classification Search
CPC ..... B41J 2/04536; B41J 2/04541; B41J 2/04586; B41J 2/04555; G11C 16/10; G11C 16/26
See application file for complete search history.

(56) References Cited

U.S. PATENT DOCUMENTS

| | | | |
|---|---|---|---|
| 5,477,245 | A | 12/1995 | Fuse |
| 5,646,672 | A | 7/1997 | Fukushima |
| 5,745,409 | A | 4/1998 | Wong et al. |
| 5,801,980 | A | 9/1998 | Wong |
| 5,917,509 | A | 6/1999 | Becerra |
| 5,942,900 | A | 8/1999 | DeMeerleer e |
| 6,038,166 | A | 3/2000 | Wong |

(Continued)

FOREIGN PATENT DOCUMENTS

| | | |
|---|---|---|
| CL | 2021001879 A1 | 2/2022 |
| CN | 1292753 | 4/2001 |

(Continued)

*Primary Examiner* — Thinh H Nguyen
(74) *Attorney, Agent, or Firm* — Foley & Lardner LLP

(57) ABSTRACT

An integrated circuit to drive a plurality of fluid actuation devices includes an interface, a first sensor, a second sensor, and control logic. The interface is to connect to a single contact pad of a host print apparatus. The first sensor is of a first type and is coupled to the interface. The second sensor is of a second type and is coupled to the interface. The second type is different from the first type. The control logic enables the first sensor or the second sensor to provide an enabled sensor. A voltage bias or a current bias applied to the interface generates a sensed current or a sensed voltage, respectively, on the interface indicating the state of the enabled sensor.

21 Claims, 10 Drawing Sheets

(56) References Cited

U.S. PATENT DOCUMENTS

| | | | | |
|---|---|---|---|---|
| 6,116,714 | A | 9/2000 | Imanaka et al. | |
| 6,161,916 | A | 12/2000 | Gibson et al. | |
| 6,398,332 | B1 | 6/2002 | Silverbrook et al. | |
| 6,616,260 | B2 | 9/2003 | Skene et al. | |
| 6,866,359 | B2 | 3/2005 | Pan et al. | |
| 7,267,417 | B2 | 9/2007 | Silverbrook et al. | |
| 7,506,961 | B2 | 3/2009 | Silverbrook | |
| 7,510,255 | B2 | 3/2009 | Tamura et al. | |
| 7,613,661 | B2 | 11/2009 | Nambudiri | |
| 7,802,858 | B2 | 9/2010 | Kasai | |
| 7,874,631 | B2 | 1/2011 | Sheahan et al. | |
| 7,954,929 | B2 | 6/2011 | Edelen et al. | |
| 8,064,266 | B2 | 11/2011 | Roohparvar | |
| 8,474,943 | B2 | 7/2013 | Ness et al. | |
| 8,561,910 | B2 | 10/2013 | Depaula et al. | |
| 8,888,226 | B1 | 11/2014 | Gardner | |
| 8,960,848 | B2 | 2/2015 | Yokouchi | |
| 8,977,782 | B2 | 3/2015 | Miyasaka | |
| 9,224,480 | B2 | 12/2015 | Grant et al. | |
| 9,472,288 | B2 | 10/2016 | Gardner et al. | |
| 9,493,002 | B2 | 11/2016 | Edelen et al. | |
| 9,592,664 | B2 | 3/2017 | Ge et al. | |
| 2002/0015066 | A1 | 2/2002 | Siwinski et al. | |
| 2004/0017437 | A1 | 1/2004 | Yamaguchi | |
| 2004/0239712 | A1 | 12/2004 | Liao et al. | |
| 2005/0099458 | A1 | 5/2005 | Edelen | |
| 2005/0140703 | A1 | 6/2005 | Ou | |
| 2007/0194371 | A1 | 8/2007 | Benjamin | |
| 2008/0049498 | A1 | 2/2008 | Werner | |
| 2009/0040286 | A1 | 2/2009 | Tan et al. | |
| 2009/0244132 | A1 | 10/2009 | Bruce | |
| 2009/0251969 | A1 | 10/2009 | Roohparvar | |
| 2010/0277527 | A1 | 11/2010 | Silverbrook et al. | |
| 2010/0302293 | A1 | 12/2010 | Torgerson et al. | |
| 2011/0018951 | A1* | 1/2011 | Muraki | B41J 2/355 347/192 |
| 2012/0057408 | A1 | 3/2012 | Roohparvar et al. | |
| 2013/0106930 | A1 | 5/2013 | Lea | |
| 2015/0243362 | A1 | 8/2015 | Nigam | |
| 2016/0009079 | A1 | 1/2016 | Clark et al. | |
| 2016/0185123 | A1 | 6/2016 | Anderson et al. | |
| 2016/0229179 | A1 | 8/2016 | Anderson | |
| 2016/0250849 | A1* | 9/2016 | Sasaki | B41J 2/04586 347/10 |
| 2017/0028724 | A1 | 2/2017 | Edelen et al. | |
| 2017/0069639 | A1 | 3/2017 | Ge et al. | |
| 2017/0120590 | A1 | 5/2017 | Chen | |
| 2017/0355188 | A1 | 12/2017 | Anderson et al. | |
| 2018/0001618 | A1 | 1/2018 | Anderson et al. | |
| 2018/0086122 | A1 | 3/2018 | Anderson | |
| 2018/0154632 | A1 | 6/2018 | Chen et al. | |
| 2018/0215147 | A1 | 8/2018 | Cumbie et al. | |
| 2018/0345667 | A1 | 12/2018 | Edelen et al. | |
| 2019/0016127 | A1 | 1/2019 | Linn | |
| 2019/0126632 | A1 | 5/2019 | Anderson et al. | |

FOREIGN PATENT DOCUMENTS

| | | | |
|---|---|---|---|
| CN | 1332412 | | 1/2002 |
| CN | 1727186 | | 2/2006 |
| CN | 1749980 | A | 3/2006 |
| CN | 1960875 | | 5/2007 |
| CN | 101567362 | A | 10/2009 |
| CN | 101683788 | A | 3/2010 |
| CN | 101868356 | | 10/2010 |
| CN | 101983378 | | 3/2011 |
| CN | 103619601 | | 3/2014 |
| CN | 105280637 | A | 1/2016 |
| CN | 105636789 | | 6/2016 |
| CN | 105873765 | A | 8/2016 |
| CN | 106685425 | A | 5/2017 |
| CN | 107073949 | A | 8/2017 |
| CN | 107111537 | | 8/2017 |
| CN | 107206815 | | 9/2017 |
| CN | 107428167 | A | 12/2017 |
| CN | 108886366 | | 11/2018 |
| CN | 109922964 | A | 6/2019 |
| EP | 1170132 | A2 | 1/2002 |
| EP | 1054772 | A2 | 7/2003 |
| EP | 1232868 | A2 | 8/2006 |
| JP | 61-011845 | A | 1/1986 |
| JP | 08-127162 | A | 5/1996 |
| JP | 11-207948 | A | 8/1999 |
| JP | 2002-014870 | A | 1/2002 |
| JP | 2002-519808 | A | 7/2002 |
| JP | 2002-232113 | A | 8/2002 |
| JP | 2004-050637 | A | 2/2004 |
| JP | 2011-517006 | A | 5/2011 |
| JP | 2011-230374 | A | 11/2011 |
| JP | 2014-017049 | A | 1/2014 |
| JP | 2017-533126 | A | 11/2017 |
| KR | 20180005525 | A | 1/2018 |
| RU | 2579814 | C2 | 4/2016 |
| RU | 2635080 02 | | 11/2017 |
| TW | 200631798 | A | 9/2006 |
| TW | 201637880 | A | 11/2016 |
| TW | 201637881 | A | 11/2016 |
| TW | 201813825 | A | 4/2018 |
| WO | 97/18953 | A1 | 5/1997 |
| WO | WO-2009064271 | A1 | 5/2009 |
| WO | WO-2013048430 | | 4/2013 |
| WO | WO-2014133534 | A1 | 9/2014 |
| WO | WO-2016068927 | A1 | 5/2016 |
| WO | WO-2017189009 | A1 | 11/2017 |
| WO | 2018/017066 | A1 | 1/2018 |
| WO | 2018/156617 | A2 | 8/2018 |
| WO | WO-2018143942 | A1 | 8/2018 |
| WO | WO-2018156171 | A1 | 8/2018 |
| WO | 2018/190864 | A1 | 10/2018 |
| WO | WO-2019009902 | A1 | 1/2019 |
| WO | WO-2019009904 | A1 | 1/2019 |
| WO | 2020/162971 | A1 | 8/2020 |

* cited by examiner

MULTIPLE CIRCUITS COUPLED TO AN INTERFACE

CROSS-REFERENCE TO RELATED APPLICATIONS

This application is a U.S. National Stage Application of PCT Application No. PCT/US2019/016725, filed Feb. 6, 2019, entitled "MULTIPLE CIRCUITS COUPLED TO AN INTERFACE".

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Fluid ejection dies, such as thermal inkjet (TIJ) dies may be narrow and long pieces of silicon. To minimize the total number of contact pads on a die, it is desirable for at least some of the contact pads to provide multiple functions. Accordingly, disclosed herein are integrated circuits (e.g., fluid ejection dies) including a multipurpose contact pad (e.g., sense pad) coupled to a memory, thermal sensors, internal test logic, a timer circuit, a crack detector, and/or other circuitry. The multipurpose contact pad receives signals from each of the circuits (e.g., one at a time), which may be read by printer logic. By using a single contact pad for multiple functions, the number of contact pads on the integrated circuit may be reduced. In addition, the printer logic coupled to the contact pad may be simplified.

As used herein a "logic high" signal is a logic "1" or "on" signal or a signal having a voltage about equal to the logic power supplied to an integrated circuit (e.g., between about 1.8 V and 15 V, such as 5.6 V). As used herein a "logic low" signal is a logic "0" or "off" signal or a signal having a voltage about equal to a logic power ground return for the logic power supplied to the integrated circuit (e.g., about 0 V).

Figure 1A:
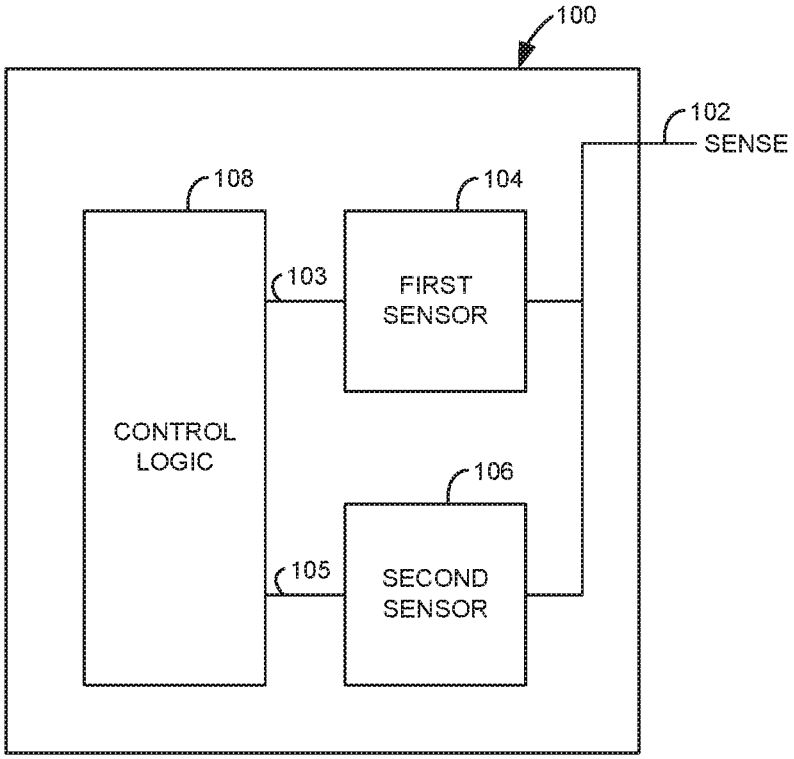
FIG. 1A is a block diagram illustrating one example of an integrated circuit to drive a plurality of fluid actuation devices.

FIG. 1A is a block diagram illustrating one example of an integrated circuit 100 to drive a plurality of fluid actuation devices. Integrated circuit 100 includes an interface (e.g., sense interface) 102, a first sensor 104, a second sensor 106, and control logic 108. Interface 102 is electrically coupled to first sensor 104 and second sensor 106. First sensor 104 is electrically coupled to control logic 108 through a signal path 103. Second sensor 106 is electrically coupled to control logic 108 through a signal path 105.

The interface 102 is configured to connect to a single contact pad of a host print apparatus, such as fluid ejection system 700 which will be described below with reference to FIG. 10. The first sensor 104 may be of a first type (e.g., a sensor read by biasing with a voltage) and the second sensor 106 may be of a second type (e.g., a sensor read by biasing with a current) different from the first type. Control logic 108 enables the first sensor 104 or the second sensor 106 to provide an enabled sensor. A voltage bias or a current bias applied to the interface 102 generates a sensed current or a sensed voltage, respectively, on the interface 102 indicating the state of the enabled sensor.

In one example, the first sensor 104 includes a thermal diode and the second sensor 106 includes a crack detector. Interface 102 may include a contact pad, a pin, a bump, or a wire. In one example, control logic 108 enables or disables the first sensor 104 and enables or disables the second sensor 106 based on data passed to integrated circuit 100. In another example, control logic 108 enables or disables the first sensor 104 and enables or disables the second sensor 106 based on data stored in a configuration register (not shown) of integrated circuit 100. Control logic 108 may include transistor switches, tristate buffers, and/or other suitable logic circuitry for controlling the operation of integrated circuit 100.

Figure 1B:
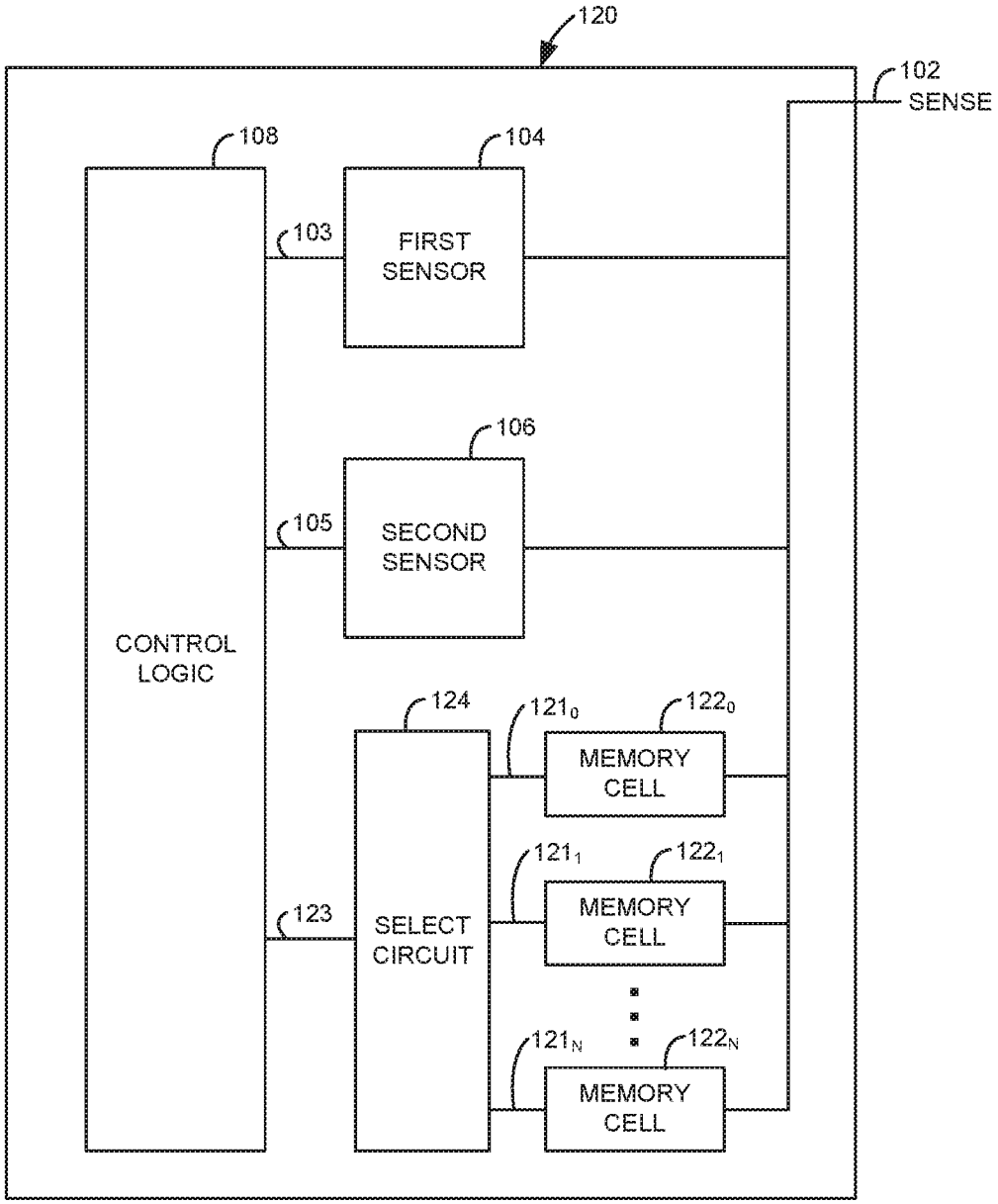
FIG. 1B is a block diagram illustrating another example of an integrated circuit to drive a plurality of fluid actuation devices.

FIG. 1B is a block diagram illustrating another example of an integrated circuit 120 to drive a plurality of fluid actuation devices. Integrated circuit 120 includes an interface (e.g., sense interface) 102, a first sensor 104, a second sensor 106, and control logic 108. In addition, integrated circuit 120 includes a plurality of memory cells $\mathbf{122}_0$ to $122_N$, where "N" in any suitable number of memory cells, and a select circuit 124. Interface 102 is electrically coupled to each memory cell $122_0$ to $122_N$. Each memory cell $122_0$ to $122_N$ is electrically coupled to select circuit 124 through a signal path $121_0$ to $121_N$, respectively. Select circuit 124 is electrically coupled to control logic 108 through a signal path 123.

The select circuit 124 selects at least one memory cell of the plurality of memory cells $122_0$ to $122_N$. The control logic 108 enables either the first sensor 104, the second sensor 106, or the selected at least one memory cell such that a voltage bias or a current bias applied to the interface 102 generates a sensed current or a sensed voltage, respectively, on the interface 102 indicating the state of the enabled sensor or the selected at least one memory cell.

In one example, each of the plurality of memory cells $122_0$ to $122_N$ includes a non-volatile memory cell, such as a floating gate transistor (e.g., a floating gate metal-oxide-semiconductor field-effect transistor), a programmable fuse, etc. In one example, select circuit 124 may include an address decoder, activation logic, and/or other suitable logic circuitry for selecting at least one memory cell $122_0$ to $122_N$ in response to an address signal and a data signal.

Figure 2:
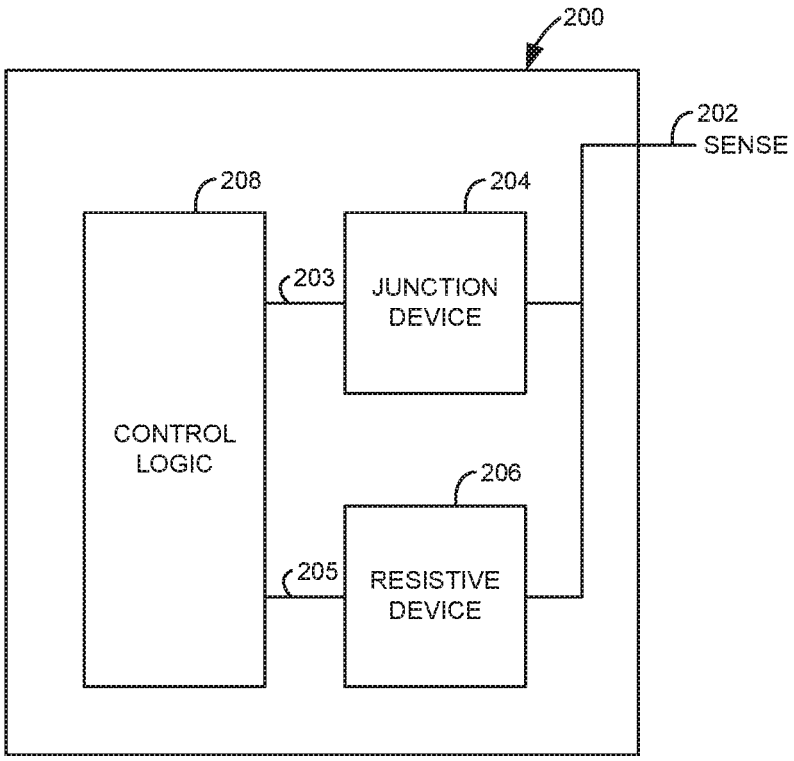
FIG. 2 is a block diagram illustrating another example of an integrated circuit to drive a plurality of fluid actuation devices.

FIG. 2 is a block diagram illustrating another example of an integrated circuit 200 to drive a plurality of fluid actuation devices. Integrated circuit 200 includes an interface (e.g., sense interface) 202, a junction device 204, a resistive device 206, and control logic 208. Interface 202 is electrically coupled to junction device 204 and resistive device 206. Junction device 204 is electrically coupled to control logic 208 through a signal path 203. Resistive device 206 is electrically coupled to control logic 208 through a signal path 205.

Figure 10:
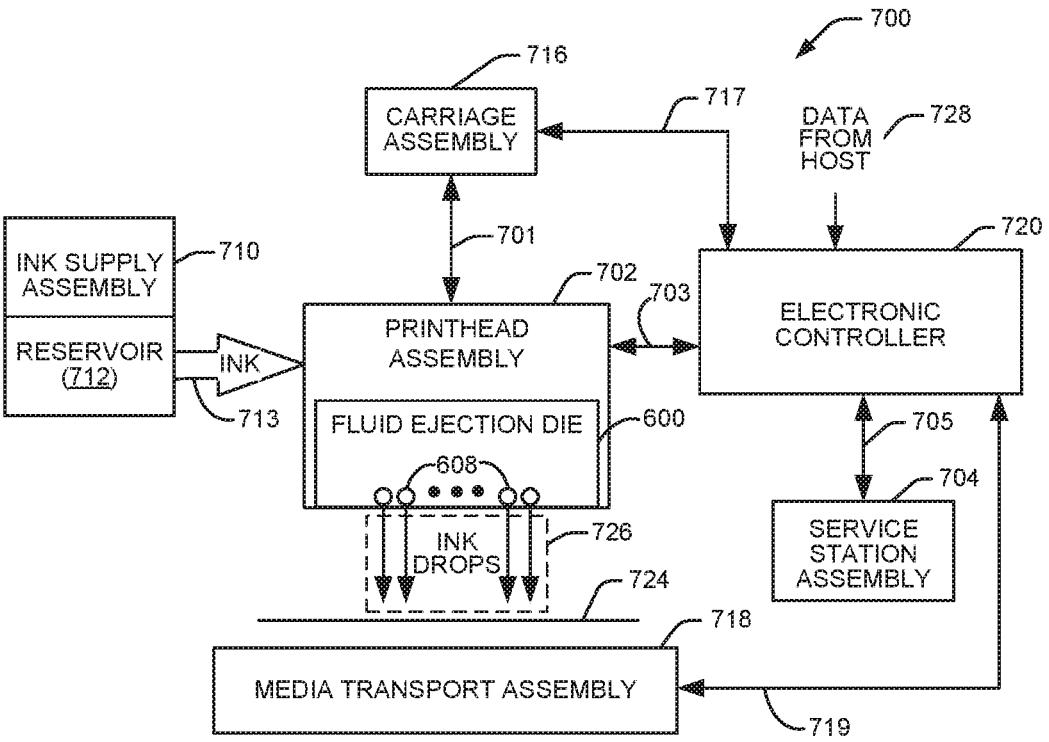
FIG. 10 is a block diagram illustrating one example of a fluid ejection system.

The interface 202 is configured to connect to a single contact pad of a host print apparatus, such as the fluid ejection system of FIG. 10. Control logic 208 enables the junction device 204 or the resistive device 206 to provide an enabled device. A voltage bias or a current bias applied to the interface 202 generates a sensed current or a sensed voltage, respectively, on the interface 202 indicating the state of the enabled device.

In one example, the junction device 204 includes a thermal diode and the resistive device 206 includes a crack detector. Interface 202 may include a contact pad, a pin, a bump, or a wire. In one example, control logic 208 enables or disables the junction device 204 and enables or disables the resistive device 206 based on data passed to integrated circuit 200. In another example, control logic 208 enables or disables the junction device 204 and enables or disables the resistive device 206 based on data stored in a configuration register (not shown) of integrated circuit 200. Control logic 208 may include transistor switches, tristate buffers, and/or other suitable logic circuitry for controlling the operation of integrated circuit 200.

Figure 3A:
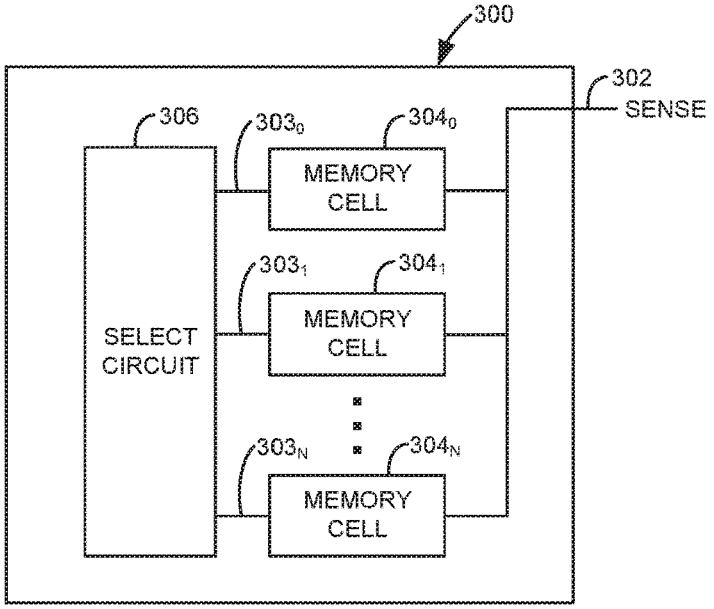
FIG. 3A is a block diagram illustrating another example of an integrated circuit to drive a plurality of fluid actuation devices.

FIG. 3A is a block diagram illustrating another example of an integrated circuit 300 to drive a plurality of fluid actuation devices. Integrated circuit 300 includes an interface (e.g., sense interface) 302, a plurality of memory cells 304*o* to $304_N$, and a select circuit 306. Interface 302 is electrically coupled to each memory cell $304_0$ to $304_N$. Each memory cell $304_0$ to $304_N$ is electrically coupled to select circuit 306 through a signal path $303_0$ to $303_N$, respectively.

The select circuit 306 selects at least one memory cell of the plurality of memory cells $304_0$ to $304_N$ such that a voltage bias or a current bias applied to the interface 302 generates a sensed current or a sensed voltage, respectively, on the interface 302 indicating the state of the selected at least one memory cell. In one example, each memory cell $304_0$ to $304_N$ includes a floating gate transistor (e.g., a floating gate metal-oxide-semiconductor field-effect transistor). In another example, each memory cell $304_0$ to $304_N$ includes a programmable fuse. In one example, select circuit 306 may include an address decoder, activation logic, and/or other suitable logic circuitry for selecting at least one memory cell $304_0$ to $304_N$ in response to an address signal and a data signal.

Figure 3B:
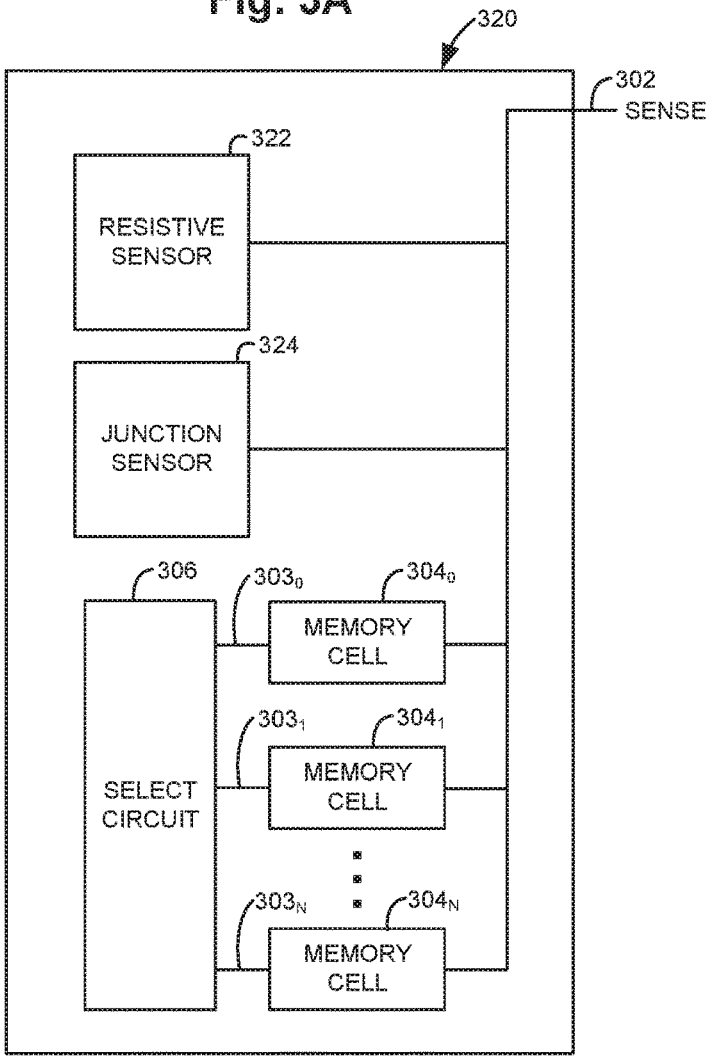
FIG. 3B is a block diagram illustrating another example of an integrated circuit to drive a plurality of fluid actuation devices.

FIG. 3B is a block diagram illustrating another example of an integrated circuit 320 to drive a plurality of fluid actuation devices. Integrated circuit 320 includes an interface (e.g., sense interface) 302, a plurality of memory cells 304*o* to $304_N$, and a select circuit 306. In addition, integrated circuit 320 includes a resistive sensor 322 and a junction sensor 324. Interface 302 is electrically coupled to resistive sensor 322 and junction sensor 324.

In one example, the resistive sensor 322 may include a crack detector, such as a resistor. In one example, the junction sensor 324 may include a thermal sensor, such as a thermal diode. A voltage bias or a current bias applied to the interface 302 generates a sensed current or a sensed voltage, respectively, on the interface 302 indicating the state of the resistive sensor 322, the junction sensor 324, or a selected memory cell $304_0$ to $304_N$.

Figure 4:
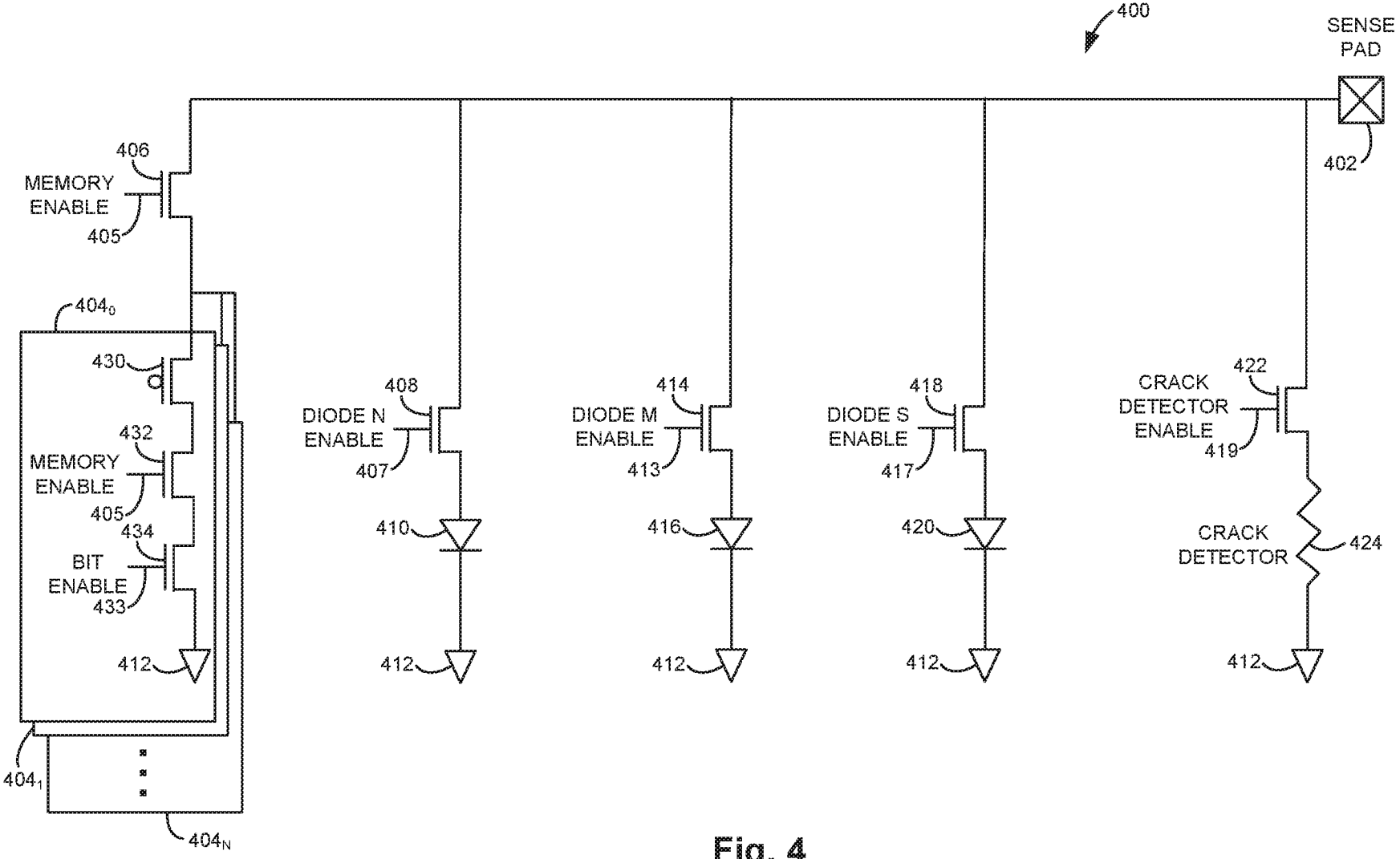
FIG. 4 is a schematic diagram illustrating one example of a circuit coupled to an interface.

FIG. 4 is a schematic diagram illustrating one example of a circuit 400 coupled to an interface (e.g., sense pad) 402. Circuit 400 includes a plurality of memory cells $404_0$ to $404_N$, transistors 406, 408, 414, 418, and 422, thermal diodes 410, 416, and 420, and a crack detector 424. Each memory cell $404_0$ to $404_N$ includes a floating gate transistor 430 and transistors 432 and 434. Sense pad 402 is electrically coupled to one side of the source-drain path of transistor 406, one side of the source-drain path of transistor 408, one side of the source-drain path of transistor 414, one side of the source-drain path of transistor 418, and one side of the source-drain path of transistor 422. The gate of transistor 406 is electrically coupled to a memory enable signal path 405. The other side of the source-drain path of transistor 406 is electrically coupled to one side of the source-drain path of the floating gate transistor 430 of each memory cell $404_0$ to $404_N$.

While memory cell $404_0$ is illustrated and described herein, the other memory cells $404_1$ to $404_N$ include a similar circuit as memory cell 404*o*. The other side of the source-drain path of floating gate transistor 430 is electrically coupled to one side of the source-drain path of transistor 432. The gate of transistor 432 is electrically coupled to memory enable signal path 405. The other side of the source-drain path of transistor 432 is electrically coupled to one side of the source-drain path of transistor 434. The gate of transistor 434 is electrically coupled to a bit enable signal path 433. The other side of the source-drain path of transistor 434 is electrically coupled to a common or ground node 412.

The gate of transistor 408 is electrically coupled to a diode north (N) enable signal path 407. The other side of the source-drain path of transistor 408 is electrically coupled to the anode of thermal diode 410. The cathode of thermal diode 410 is electrically coupled to a common or ground node 412. The gate of transistor 414 is electrically coupled to a diode middle (M) enable signal path 413. The other side of the source-drain path of transistor 414 is electrically coupled to the anode of thermal diode 416. The cathode of thermal diode 416 is electrically coupled to a common or ground node 412. The gate of transistor 418 is electrically coupled to a diode south (S) enable signal path 417. The other side of the source-drain path of transistor 418 is electrically coupled to the anode of thermal diode 420. The cathode of thermal diode 420 is electrically coupled to a common or ground node 412. The gate of transistor 422 is electrically coupled to a crack detector enable signal path 419. The other side of the source-drain path of transistor 422 is electrically coupled to one side of crack detector 424. The other side of crack detector 424 is electrically coupled to a common or ground node 412.

The memory enable signal on memory enable signal path 405 determines whether a memory cell $\mathbf{404}_0$ to $\mathbf{404}_N$ may be accessed. In response to a logic high memory enable signal, transistors 406 and 432 are turned on (i.e., conducting) to enable access to memory cells $\mathbf{404}_0$ to $\mathbf{404}_N$. In response to a logic low memory enable signal, transistors 406 and 432 are turned off to disable access to memory cells $\mathbf{404}_0$ to $\mathbf{404}_N$. With a logic high memory enable signal, a bit enable signal may be activated to access a selected memory cell $\mathbf{404}_0$ to $\mathbf{404}_N$. With a logic high bit enable signal, transistor 434 is turned on to access the corresponding memory cell. With a logic low bit enable signal, transistor 434 is turned off to block access to the corresponding memory cell. With a logic high memory enable signal and a logic high bit enable signal, the floating gate transistor 430 of the corresponding memory cell may be accessed for read and write operations through sense pad 402. In one example, the memory enable signal may be based on a data bit stored in a configuration register (not shown). In another example, the memory enable signal may be based on data passed to circuit 400 from a fluid ejection system, such as fluid ejection system 700 to be described below with reference to FIG. 10. In one example, the bit enable signal may be based on data passed to circuit 400 from a fluid ejection system.

Thermal diode 410 may be enabled or disabled via a corresponding diode N enable signal on diode N enable signal path 407. In response to a logic high diode N enable signal, the transistor 408 is turned on to enable the thermal diode 410 by electrically connecting thermal diode 410 to sense pad 402. In response to a logic low diode N enable signal, the transistor 408 is turned off to disable the thermal diode 410 by electrically disconnecting thermal diode 410 from sense pad 402. With thermal diode 410 enabled, the thermal diode 410 may be read through sense pad 402, such as by applying a current to sense pad 402 and sensing a voltage on sense pad 402 indicative of the temperature of thermal diode 410. In one example, the diode N enable signal may be based on data stored in a configuration register (not shown). In another example, the diode N enable signal may be based on data passed to circuit 400 from a fluid ejection system. Thermal diode 410 may be arranged at the northern or upper portion of a fluid ejection die as illustrated in FIG. 9A.

Thermal diode 416 may be enabled or disabled via a corresponding diode M enable signal on diode M enable signal path 413. In response to a logic high diode M enable signal, the transistor 414 is turned on to enable the thermal diode 416 by electrically connecting thermal diode 416 to sense pad 402. In response to a logic low diode M enable signal, the transistor 414 is turned off to disable the thermal diode 416 by electrically disconnecting thermal diode 416 from sense pad 402. With thermal diode 416 enabled, the thermal diode 416 may be read through sense pad 402, such as by applying a current to sense pad 402 and sensing a voltage on sense pad 402 indicative of the temperature of thermal diode 416. In one example, the diode M enable signal may be based on data stored in a configuration register (not shown). In another example, the diode M enable signal may be based on data passed to circuit 400 from a fluid ejection system. Thermal diode 416 may be arranged in a middle or central portion of a fluid ejection die as illustrated in FIG. 9A.

Thermal diode 420 may be enabled or disabled via a corresponding diode S enable signal on diode S enable signal path 417. In response to a logic high diode S enable signal, the transistor 418 is turned on to enable the thermal diode 420 by electrically connecting thermal diode 420 to sense pad 402. In response to a logic low diode S enable signal, the transistor 418 is turned off to disable the thermal diode 420 by electrically disconnecting thermal diode 420 from sense pad 402. With thermal diode 420 enabled, the thermal diode 420 may be read through sense pad 402, such as by applying a current to sense pad 402 and sensing a voltage on sense pad 402 indicative of the temperature of thermal diode 420. In one example, the diode S enable signal may be based on data stored in a configuration register (not shown). In another example, the diode S enable signal may be based on data passed to circuit 400 from a fluid ejection system. Thermal diode 420 may be arranged in a southern or lower portion of a fluid ejection die as illustrated in FIG. 9A. Thus, the thermal diodes 410, 416, and 420 may be spaced apart along a length of a fluid ejection die.

Figure 9A:
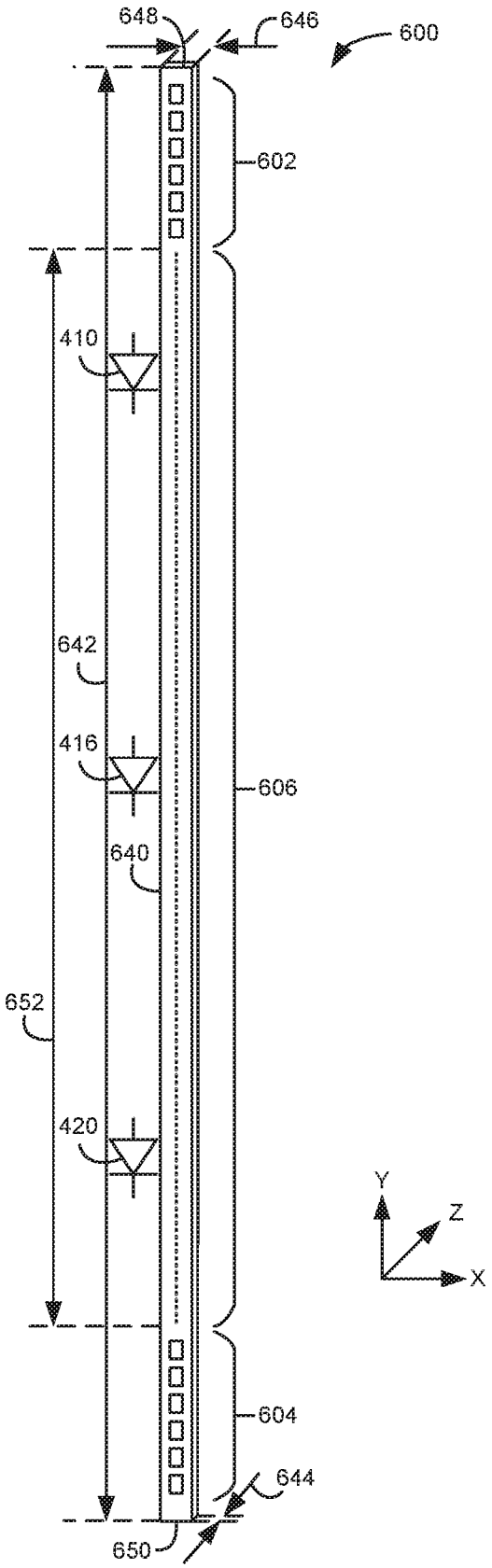
FIGS. 9A and 9B illustrate one example of a fluid ejection die.
Figure 9B:
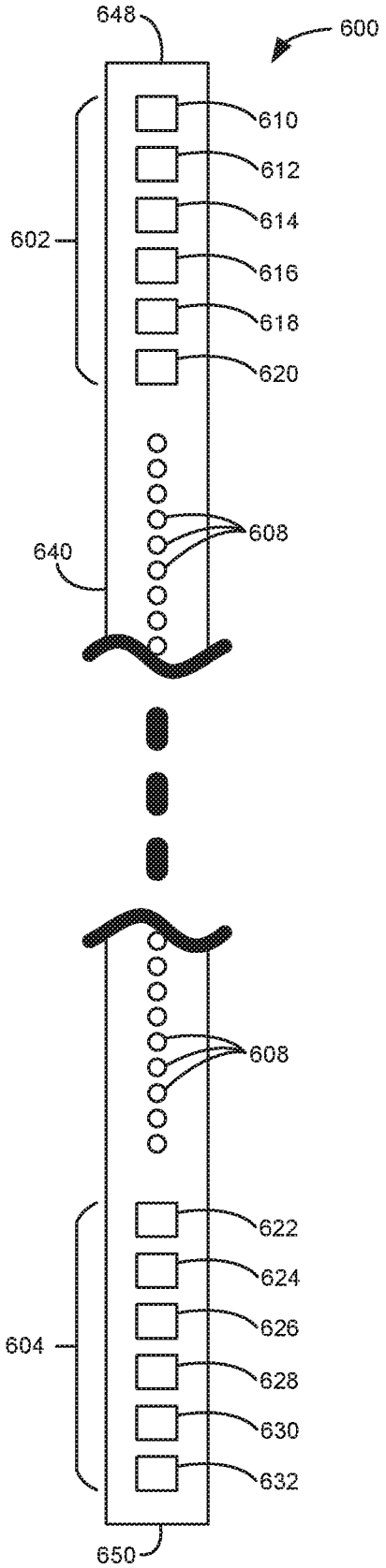

In one example, crack detector 424 includes a resistor wiring separate from and extending along at least a subset of fluid actuation devices (e.g., fluid actuation devices 608 of FIGS. 9A and 9B). Crack detector 424 may be enabled or disabled in response to a crack detector enable signal on crack detector enable signal path 419. In response to a logic high crack detector enable signal, the transistor 422 is turned on to enable crack detector 424 by electrically connecting crack detector 424 to sense pad 402. In response to a logic low crack detector enable signal, the transistor 422 is turned off to disable the crack detector 424 by electrically disconnecting crack detector 424 from sense pad 402. With crack detector 424 enabled, the crack detector 424 may be read through sense pad 402, such as by applying a current or voltage to sense pad 402 and sensing a voltage or current, respectively, on sense pad 402 indicative of the state of crack detector 424. In one example, the crack detector enable signal may be based on data stored in a configuration register (not shown). In another example, the crack detector enable signal may be based on data passed to circuit 400 from a fluid ejection system.

Figure 5A:
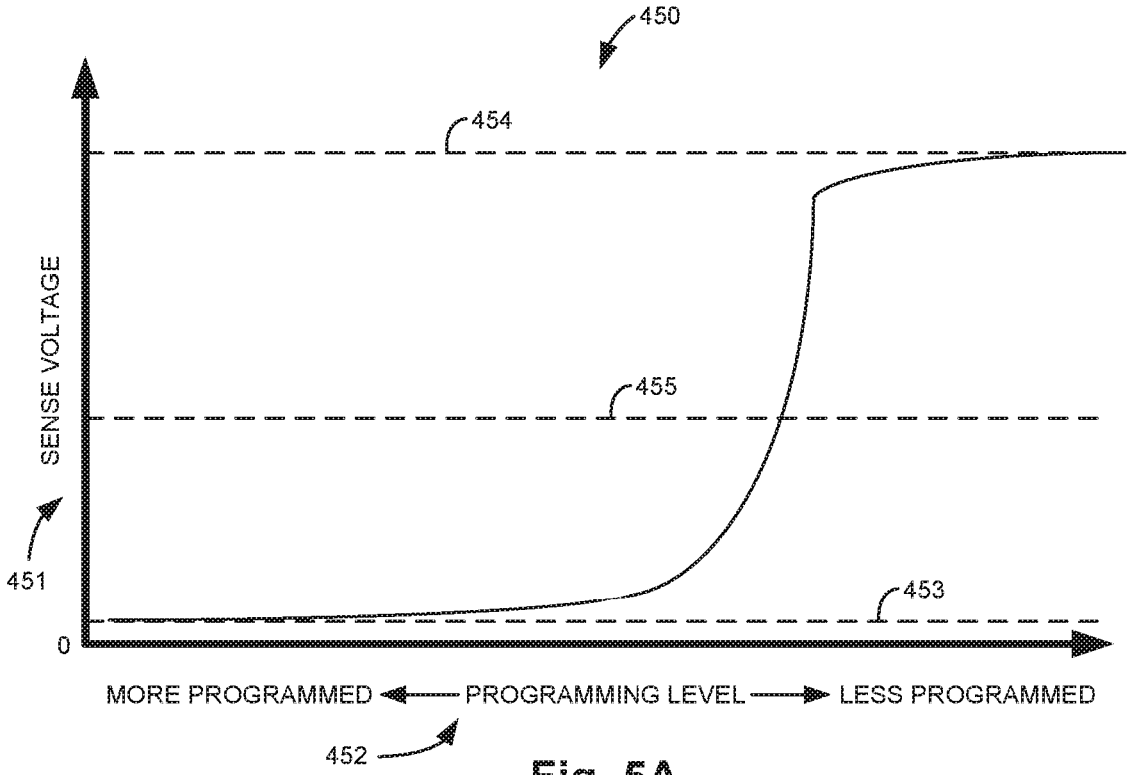
FIGS. 5A and 5B are charts illustrating examples of reading a memory cell.

FIG. 5A is a chart 450 illustrating one example of reading a memory cell, such as a memory cell $\mathbf{404}_0$ to $\mathbf{404}_N$ of FIG. 4. In this example, a current is applied to the sense pad 402 and a voltage, indicating the state of the floating gate transistor 430, is sensed through the sense pad 402. The sensed voltage, as indicated at 451, depends on the programming level of the floating gate transistor, as indicated at 452. A fully programmed state of the memory cell may be detected for a sensed voltage indicated at 453. A fully unprogrammed state of the memory cell may be detected for a sensed voltage indicated at 454. The memory cell may be programmed to any state between the fully programmed state 453 and the unprogrammed state 454. Accordingly, in one example, if the sensed voltage is above a threshold 455, the memory cell may be determined to store a "0". If the sensed voltage is below the threshold 455, the memory cell may be determined to store a "1".

Figure 5B:
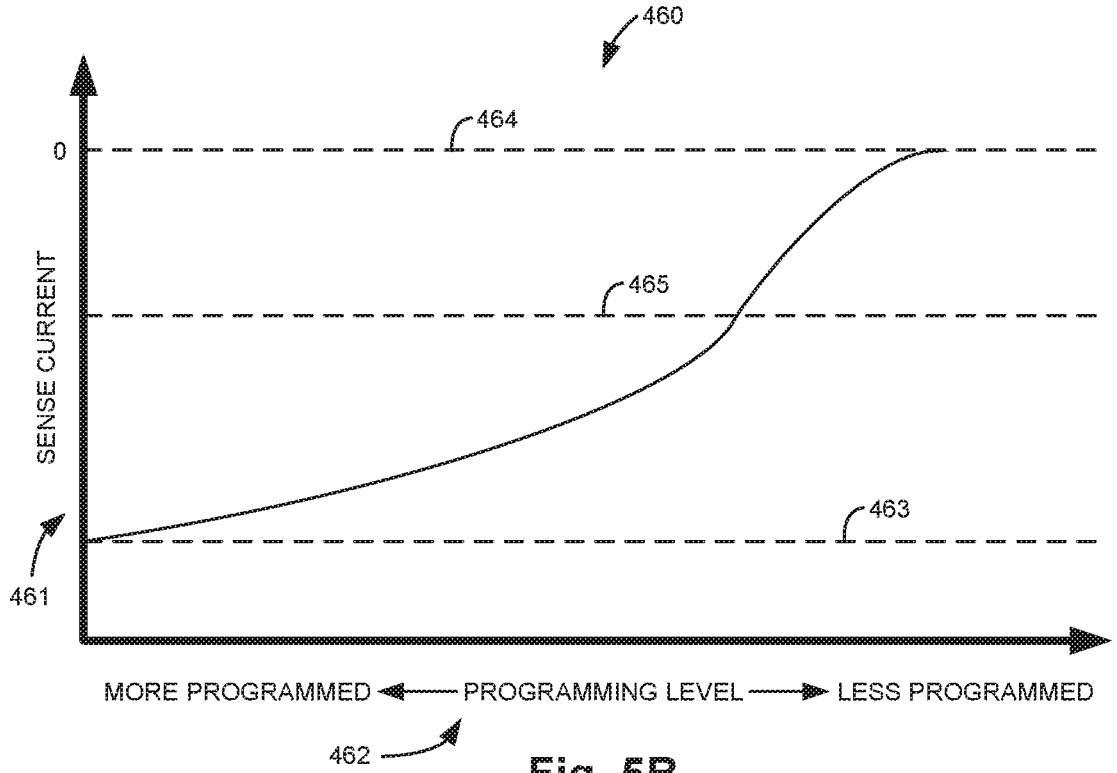

FIG. 5B is a chart 460 illustrating another example of reading a memory cell, such as a memory cell $\mathbf{404}_0$ to $\mathbf{404}_N$ of FIG. 4. In this example, a voltage is applied to the sense pad 402 and a current, indicating the state of the floating gate transistor 430, is sensed through the sense pad 402. The sensed current, as indicated at 461, depends on the programming level of the floating gate transistor, as indicated at 462. A fully programmed state of the memory cell may be detected for a sensed current indicated at 463. A fully unprogrammed state of the memory cell may be detected for a sensed current indicated at 464. The memory cell may be programmed to any state between the fully programmed state 463 and the unprogrammed state 464. Accordingly, in one example, if the sensed current is above a threshold 465, the memory cell may be determined to store a "0". If the sensed current is below the threshold 465, the memory cell may be determined to store a "1".

Figure 6:
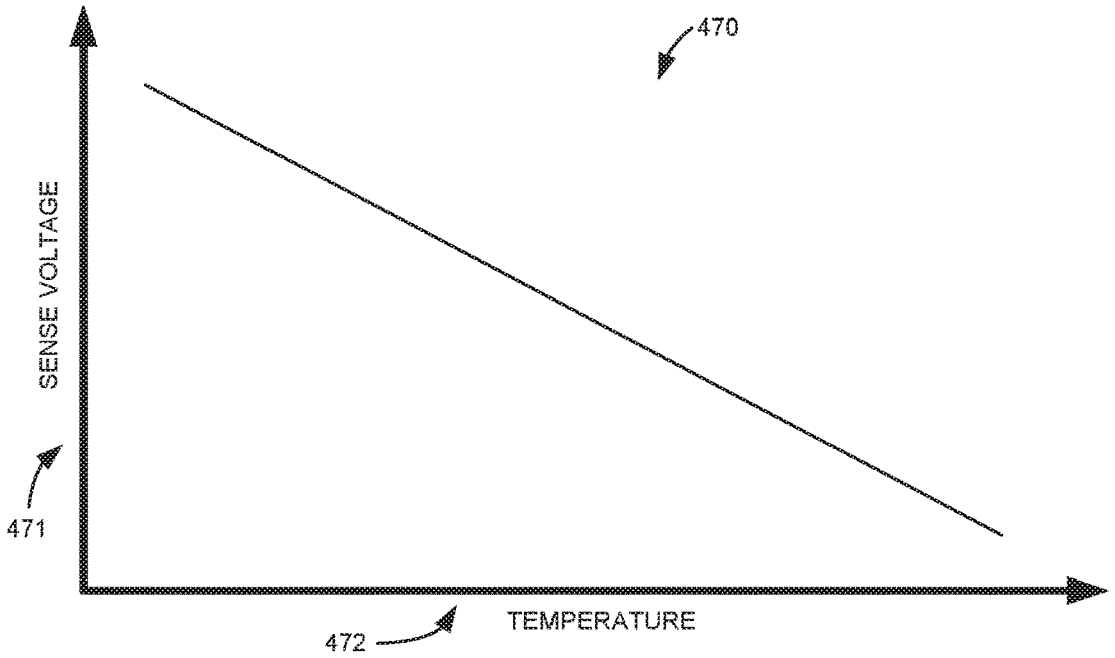
FIG. 6 is a chart illustrating one example of reading a thermal sensor.

FIG. 6 is a chart 470 illustrating one example of reading a thermal sensor, such as a thermal diode 410, 416, or 420 of FIG. 4. In this example, a current is applied to the sense pad 402 and a voltage, indicating the temperature of the thermal diode, is sensed through the sense pad 402. The sensed voltage, as indicated at 471, depends on the temperature of the thermal diode as indicated at 472. As shown in chart 470, as the temperature of the thermal diode increases, the sensed voltage decreases.

Figure 7A:
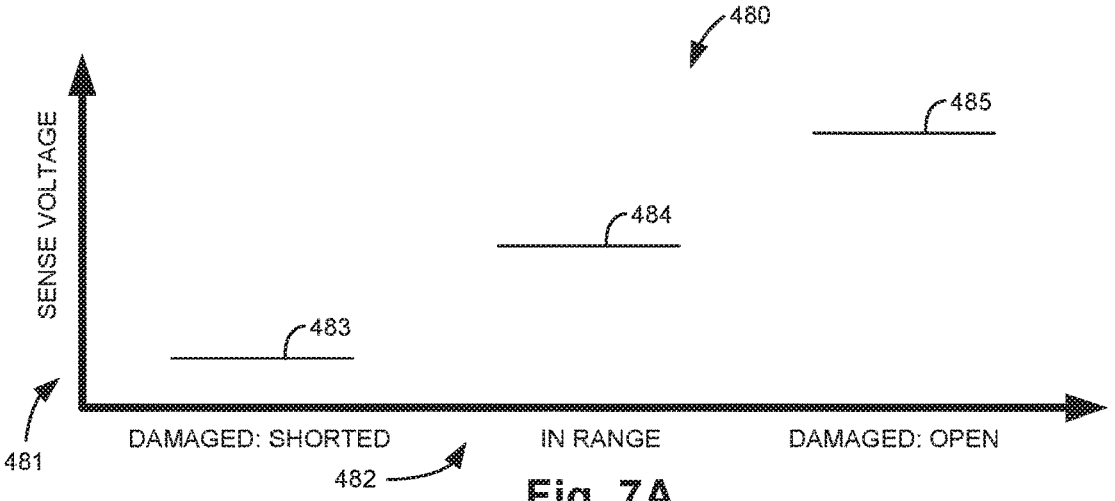
FIGS. 7A and 7B are charts illustrating examples of reading a crack detector.

FIG. 7A is a chart 480 illustrating one example of reading a crack detector, such as crack detector 424 of FIG. 4. In this example, a current is applied to the sense pad 402 and a voltage, indicating the state of the crack detector 424, is sensed through the sense pad 402. The sensed voltage, as indicated at 481, depends on the state of the crack detector 424 as indicated at 482. As shown in chart 480, a low sensed voltage as indicated at 483 indicates a damaged (i.e., shorted) crack detector, a sensed voltage in a central range as indicated at 484 indicates an undamaged crack detector, and a high sensed voltage as indicated at 485 indicates a damaged (i.e., open) crack detector.

Figure 7B:
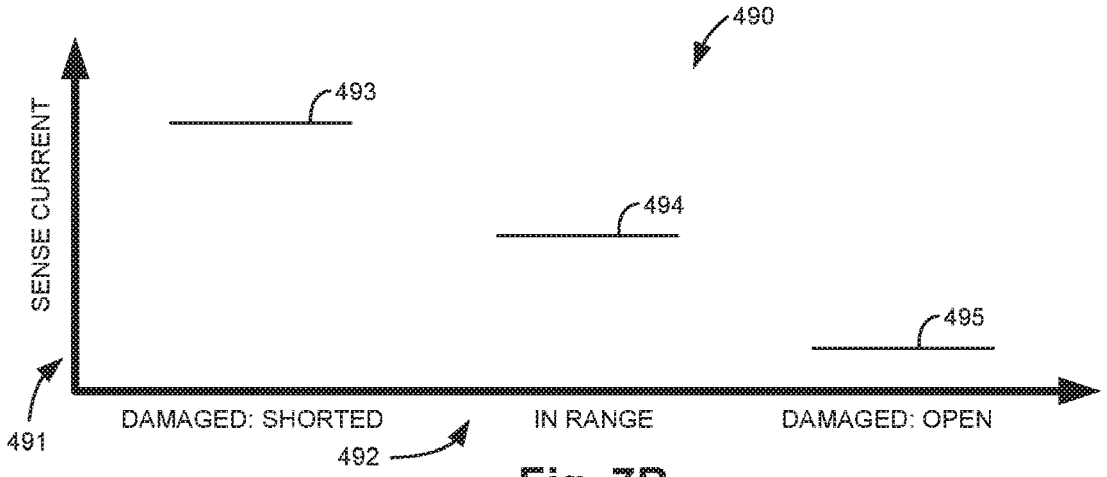

FIG. 7B is a chart 490 illustrating another example of reading a crack detector, such as crack detector 424 of FIG. 4. In this example, a voltage is applied to the sense pad 402 and a current, indicating the state of the crack detector 424, is sensed through the sense pad 402. The sensed current, as indicated at 491, depends on the state of the crack detector 424 as indicated at 492. As shown in chart 490, a high sensed current as indicated at 493 indicates a damaged (i.e., shorted) crack detector, a sensed current in a central range as indicated at 494 indicates an undamaged crack detector, and a low sensed voltage as indicated at 495 indicates a damaged (i.e., open) crack detector.

Figure 8:
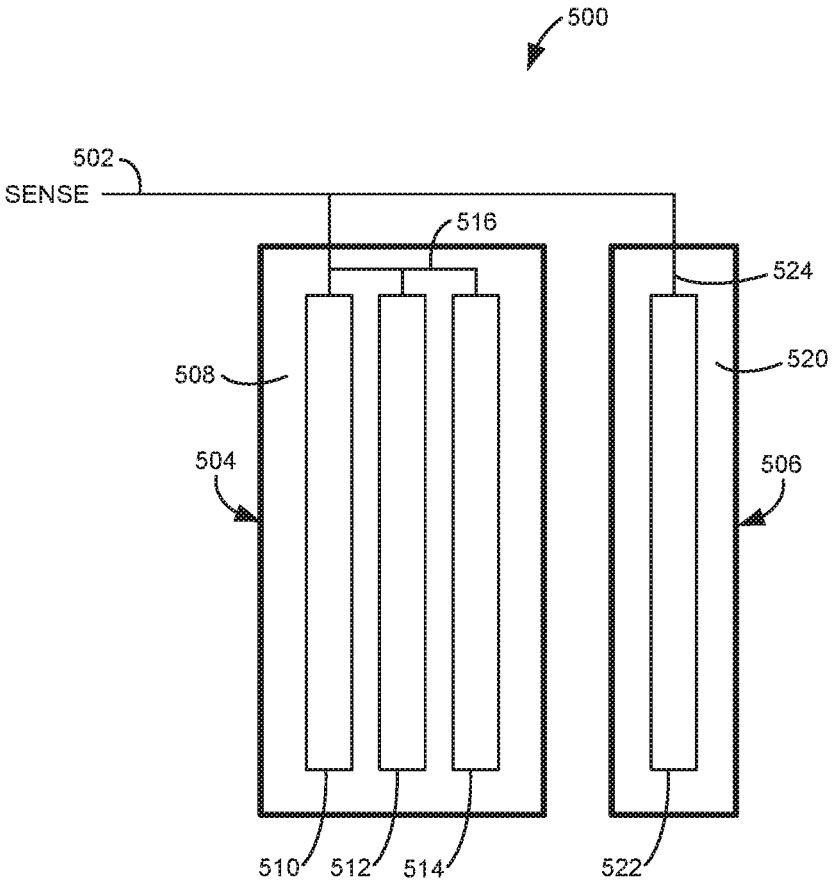
FIG. 8 illustrates one example of a fluid ejection device.

FIG. 8 illustrates one example of a fluid ejection device 500. Fluid ejection device 500 includes a sense interface 502, a first fluid ejection assembly 504 and a second fluid ejection assembly 506. First fluid ejection assembly 504 includes a carrier 508 and a plurality of elongate substrates 510, 512, and 514 (e.g., fluid ejection dies, which will be described below with reference to FIG. 9). Carrier 508 includes electrical routing 516 coupled to an interface (e.g., sense interface) of each elongate substrate 510, 512, and 514 and to sense interface 502. Second fluid ejection assembly 506 includes a carrier 520 and an elongate substrate 522 (e.g., a fluid ejection die). Carrier 520 includes electrical routing 524 coupled to an interface (e.g., sense interface) of the elongate substrate 522 and to sense interface 502. In one example, first fluid ejection assembly 504 is a color (e.g., cyan, magenta, and yellow) inkjet or fluid-jet print cartridge or pen and second fluid ejection assembly 506 is a black inkjet or fluid-jet print cartridge or pen.

In one example, each elongate substrate 510, 512, 514, and 522 includes an integrated circuit 100 of FIG. 1A, an integrated circuit 120 of FIG. 1B, an integrated circuit 200 of FIG. 2, an integrated circuit 300 of FIG. 3A, an integrated circuit 320 of FIG. 3B, or the circuit 400 of FIG. 4. Accordingly, sense interface 502 may be electrically coupled to the sense interface 102 (FIGS. 1A and 1B), sense interface 202 (FIG. 2), sense interface 302 (FIGS. 3A and 3B), or sense pad 402 (FIG. 4) of each elongate substrate. A voltage bias or a current bias applied to the electrical routing 516 and 524 through sense interface 502 generates a sensed current or a sensed voltage, respectively, on the electrical routing 516 and 524 and thus on sense interface 502 indicating the state of an enabled device (e.g., memory cell, junction device, resistive device, sensor, etc.) of any of elongate substrates 510, 512, 514, and 522.

FIG. 9A illustrates one example of a fluid ejection die 600 and FIG. 9B illustrates an enlarged view of the ends of fluid ejection die 600. In one example, fluid ejection die 600 includes integrated circuit 100 of FIG. 1A, integrated circuit 120 of FIG. 1B, integrated circuit 200 of FIG. 2, integrated circuit 300 of FIG. 3A, integrated circuit 320 of FIG. 3B, or circuit 400 of FIG. 4. Die 600 includes a first column 602 of contact pads, a second column 604 of contact pads, and a column 606 of fluid actuation devices 608.

The second column 604 of contact pads is aligned with the first column 602 of contact pads and at a distance (i.e., along the Y axis) from the first column 602 of contact pads. The column 606 of fluid actuation devices 608 is disposed longitudinally to the first column 602 of contact pads and the second column 604 of contact pads. The column 606 of fluid actuation devices 608 is also arranged between the first column 602 of contact pads and the second column 604 of contact pads. In one example, fluid actuation devices 608 are nozzles or fluidic pumps to eject fluid drops.

In one example, the first column 602 of contact pads includes six contact pads. The first column 602 of contact pads may include the following contact pads in order: a data contact pad 610, a clock contact pad 612, a logic power ground return contact pad 614, a multipurpose input/output contact (e.g., sense) pad 616, a first high voltage power supply contact pad 618, and a first high voltage power ground return contact pad 620. Therefore, the first column 602 of contact pads includes the data contact pad 610 at the top of the first column 602, the first high voltage power ground return contact pad 620 at the bottom of the first column 602, and the first high voltage power supply contact pad 618 directly above the first high voltage power ground return contact pad 620. While contact pads 610, 612, 614, 616, 618, and 620 are illustrated in a particular order, in other examples the contact pads may be arranged in a different order.

In one example, the second column 604 of contact pads includes six contact pads. The second column 604 of contact pads may include the following contact pads in order: a second high voltage power ground return contact pad 622, a second high voltage power supply contact pad 624, a logic reset contact pad 626, a logic power supply contact pad 628, a mode contact pad 630, and a fire contact pad 632. Therefore, the second column 604 of contact pads includes the second high voltage power ground return contact pad 622 at the top of the second column 604, the second high voltage power supply contact pad 624 directly below the second high voltage power ground return contact pad 622, and the fire contact pad 632 at the bottom of the second column 604. While contact pads 622, 624, 626, 628, 630, and 632 are illustrated in a particular order, in other examples the contact pads may be arranged in a different order.

Data contact pad 610 may be used to input serial data to die 600 for selecting fluid actuation devices, memory bits, thermal sensors, configuration modes (e.g. via a configuration register), etc. Data contact pad 610 may also be used to output serial data from die 600 for reading memory bits, configuration modes, status information (e.g., via a status register), etc. Clock contact pad 612 may be used to input a clock signal to die 600 to shift serial data on data contact pad 610 into the die or to shift serial data out of the die to data contact pad 610. Logic power ground return contact pad 614 provides a ground return path for logic power (e.g., about 0 V) supplied to die 600. In one example, logic power ground return contact pad 614 is electrically coupled to the semiconductor (e.g., silicon) substrate 640 of die 600. Multipurpose input/output contact pad 616 may be used for analog sensing and/or digital test modes of die 600. In one example, multipurpose input/output contact (e.g., sense) pad 616 may provide sense interface 102 of FIG. 1A or 1B, sense interface 202 of FIG. 2, sense interface 302 of FIG. 3A or 3B, or sense pad 402 of FIG. 4.

First high voltage power supply contact pad 618 and second high voltage power supply contact pad 624 may be used to supply high voltage (e.g., about 32 V) to die 600. First high voltage power ground return contact pad 620 and second high voltage power ground return contact pad 622 may be used to provide a power ground return (e.g., about 0 V) for the high voltage power supply. The high voltage power ground return contact pads 620 and 622 are not directly electrically connected to the semiconductor substrate 640 of die 600. The specific contact pad order with the high voltage power supply contact pads 618 and 624 and the high voltage power ground return contact pads 620 and 622 as the innermost contact pads may improve power delivery to die 600. Having the high voltage power ground return contact pads 620 and 622 at the bottom of the first column 602 and at the top of the second column 604, respectively, may improve reliability for manufacturing and may improve ink shorts protection.

Logic reset contact pad 626 may be used as a logic reset input to control the operating state of die 600. Logic power supply contact pad 628 may be used to supply logic power (e.g., between about 1.8 V and 15 V, such as 5.6 V) to die 600. Mode contact pad 630 may be used as a logic input to control access to enable/disable configuration modes (i.e., functional modes) of die 600. Fire contact pad 632 may be used as a logic input to latch loaded data from data contact pad 610 and to enable fluid actuation devices or memory elements of die 600.

Die 600 includes an elongate substrate 640 having a length 642 (along the Y axis), a thickness 644 (along the Z axis), and a width 646 (along the X axis). In one example, the length 642 is at least twenty times the width 646. The width 646 may be 1 mm or less and the thickness 644 may be less than 500 microns. The fluid actuation devices 608 (e.g., fluid actuation logic) and contact pads 610-632 are provided on the elongate substrate 640 and are arranged along the length 642 of the elongate substrate. Fluid actuation devices 608 have a swath length 652 less than the length 642 of the elongate substrate 640. In one example, the swath length 652 is at least 1.2 cm. The contact pads 610-632 may be electrically coupled to the fluid actuation logic. The first column 602 of contact pads may be arranged near a first longitudinal end 648 of the elongate substrate 640. The second column 604 of contact pads may be arranged near a second longitudinal end 650 of the elongate substrate 640 opposite to the first longitudinal end 648.

FIG. 10 is a block diagram illustrating one example of a fluid ejection system 700. Fluid ejection system 700 includes a fluid ejection assembly, such as printhead assembly 702, and a fluid supply assembly, such as ink supply assembly 710. In the illustrated example, fluid ejection system 700 also includes a service station assembly 704, a carriage assembly 716, a print media transport assembly 718, and an electronic controller 720. While the following description provides examples of systems and assemblies for fluid handling with regard to ink, the disclosed systems and assemblies are also applicable to the handling of fluids other than ink.

Printhead assembly 702 includes at least one printhead or fluid ejection die 600 previously described and illustrated with reference to FIGS. 9A and 9B, which ejects drops of ink or fluid through a plurality of orifices or nozzles 608. In one example, the drops are directed toward a medium, such as print media 724, so as to print onto print media 724. In one example, print media 724 includes any type of suitable sheet material, such as paper, card stock, transparencies, Mylar, fabric, and the like. In another example, print media 724 includes media for three-dimensional (3D) printing, such as a powder bed, or media for bioprinting and/or drug discovery testing, such as a reservoir or container. In one example, nozzles 608 are arranged in at least one column or array such that properly sequenced ejection of ink from nozzles 608 causes characters, symbols, and/or other graphics or images to be printed upon print media 724 as printhead assembly 702 and print media 724 are moved relative to each other.

Ink supply assembly 710 supplies ink to printhead assembly 702 and includes a reservoir 712 for storing ink. As such, in one example, ink flows from reservoir 712 to printhead assembly 702. In one example, printhead assembly 702 and ink supply assembly 710 are housed together in an inkjet or fluid-jet print cartridge or pen. In another example, ink supply assembly 710 is separate from printhead assembly 702 and supplies ink to printhead assembly 702 through an interface connection 713, such as a supply tube and/or valve.

Carriage assembly 716 positions printhead assembly 702 relative to print media transport assembly 718, and print media transport assembly 718 positions print media 724 relative to printhead assembly 702. Thus, a print zone 726 is defined adjacent to nozzles 608 in an area between printhead assembly 702 and print media 724. In one example, printhead assembly 702 is a scanning type printhead assembly such that carriage assembly 716 moves printhead assembly 702 relative to print media transport assembly 718. In another example, printhead assembly 702 is a non-scanning type printhead assembly such that carriage assembly 716 fixes printhead assembly 702 at a prescribed position relative to print media transport assembly 718.

Service station assembly 704 provides for spitting, wiping, capping, and/or priming of printhead assembly 702 to maintain the functionality of printhead assembly 702 and, more specifically, nozzles 608. For example, service station assembly 704 may include a rubber blade or wiper which is periodically passed over printhead assembly 702 to wipe and clean nozzles 608 of excess ink. In addition, service station assembly 704 may include a cap that covers printhead assembly 702 to protect nozzles 608 from drying out during periods of non-use. In addition, service station assembly 704 may include a spittoon into which printhead assembly 702 ejects ink during spits to ensure that reservoir 712 maintains an appropriate level of pressure and fluidity, and to ensure that nozzles 608 do not clog or weep. Functions of service station assembly 704 may include relative motion between service station assembly 704 and printhead assembly 702.

Electronic controller 720 communicates with printhead assembly 702 through a communication path 703, service station assembly 704 through a communication path 705, carriage assembly 716 through a communication path 717, and print media transport assembly 718 through a communication path 719. In one example, when printhead assembly 702 is mounted in carriage assembly 716, electronic controller 720 and printhead assembly 702 may communicate via carriage assembly 716 through a communication path 701. Electronic controller 720 may also communicate with ink supply assembly 710 such that, in one implementation, a new (or used) ink supply may be detected.

Electronic controller 720 receives data 728 from a host system, such as a computer, and may include memory for temporarily storing data 728. Data 728 may be sent to fluid ejection system 700 along an electronic, infrared, optical or other information transfer path. Data 728 represent, for example, a document and/or file to be printed. As such, data 728 form a print job for fluid ejection system 700 and includes at least one print job command and/or command parameter.

In one example, electronic controller 720 provides control of printhead assembly 702 including timing control for ejection of ink drops from nozzles 608. As such, electronic controller 720 defines a pattern of ejected ink drops which form characters, symbols, and/or other graphics or images on print media 724. Timing control and, therefore, the pattern of ejected ink drops, is determined by the print job commands and/or command parameters. In one example, logic and drive circuitry forming a portion of electronic controller 720 is located on printhead assembly 702. In another example, logic and drive circuitry forming a portion of electronic controller 720 is located off printhead assembly 702.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. An integrated circuit for a fluid ejection device, the integrated circuit comprising:

an interface to connect to a single contact pad of a host print apparatus;

a first sensor of a first type coupled to the interface;

a second sensor of a second type coupled to the interface, the second type being different from the first type; and control logic to enable the first sensor or the second sensor to provide an enabled sensor, wherein a voltage bias or a current bias applied to the interface generates a sensed current or a sensed voltage, respectively, on the interface indicating the state of the enabled sensor.

2. The integrated circuit of claim 1, further comprising:

a plurality of memory cells coupled to the interface; and a select circuit to select at least one memory cell of the plurality of memory cells, wherein the control logic is to enable either the first sensor, the second sensor, or the selected at least one memory cell such that a voltage bias or a current bias applied to the interface generates a sensed current or a sensed voltage, respectively, on the interface indicating the state of the enabled sensor or the selected at least one memory cell.

3. The integrated circuit of claim 2, wherein each of the plurality of memory cells comprises a floating gate transistor.

4. The integrated circuit of claim 1, wherein the first sensor comprises a thermal diode.

5. The integrated circuit of claim 1, wherein the second sensor comprises a crack detector.

6. The integrated circuit of claim 1, wherein the interface comprises a contact pad, a pin, a bump, or a wire.

7. An integrated circuit for a fluid ejection device, the integrated circuit comprising:

an interface to connect to a single contact pad of a host print apparatus and coupled to a plurality of memory cells; and a select circuit to select at least one memory cell of the plurality of memory cells such that a voltage bias or a current bias applied to the interface generates a sensed current or a sensed voltage, respectively, on the interface indicating the state of the selected at least one memory cell.

8. The integrated circuit of claim 7, wherein each of the plurality of memory cells comprises a floating gate transistor.

9. The integrated circuit of claim 7, further comprising:

a resistive sensor coupled to the interface.

10. The integrated circuit of claim 7, further comprising:

a junction sensor coupled to the interface.

11. The integrated circuit of claim 7, further comprising:

a thermal sensor coupled to the interface.

12. The integrated circuit of claim 11, wherein the thermal sensor comprises a thermal diode.

13. The integrated circuit of claim 7, further comprising:

a crack detector coupled to the interface.

14. The integrated circuit of claim 13, wherein the crack detector comprises a resistor.

15. A fluid ejection device comprising:

a carrier; and a plurality of elongate substrates arranged parallel to each other on the carrier, each elongate substrate having a length, a thickness, and a width, the length being at least twenty times the width, wherein on each elongate substrate there is provided:

an interface;

a junction device coupled to the interface;

a resistive device coupled to the interface; and control logic to enable or disable the junction device and the resistive device;

wherein the carrier comprises electrical routing coupled to the interface of each of the elongate substrates such that a voltage bias or a current bias applied to the electrical routing generates a sensed current or a sensed voltage, respectively, on the electrical routing indicating the state of an enabled junction device or an enabled resistive device.

16. The fluid ejection device of claim 15, wherein on each elongate substrate there is provided:

a plurality of memory cells coupled to the interface; and a select circuit to select at least one memory cell of the plurality of memory cells.

17. The fluid ejection device of claim 16, wherein each of the plurality of memory cells comprises a floating gate metal-oxide-semiconductor field-effect transistor.

18. The fluid ejection device of claim 16, wherein each of the plurality of memory cells comprises a fuse.

19. The fluid ejection device of claim 15, wherein the junction device comprises a thermal diode.

20. The fluid ejection device of claim 19, wherein on each elongate substrate there is provided:

a plurality of thermal diodes spaced apart along the length of the elongate substrate.

21. The fluid ejection device of claim 15, wherein the resistive device comprises a crack detector.

* * * * *